US005529531A

United States Patent [19]

Kaiser, Jr. et al.

[11] Patent Number: 5,529,531

[45] Date of Patent: Jun. 25, 1996

[54] TAPERED BEARING FOR DRIVE DRUM ASSEMBLY OF GRINDING MACHINE UTILIZING MULTIPLE, PARALLEL ABRASIVE BELTS

[75] Inventors: Russell E. Kaiser, Jr., Mercersburg; Ricky L. Mowen, Greencastle; William W. Pflager, Waynesboro; Dennis F. Rice, Chambersburg, all of Pa.

[73] Assignee: Western Atlas Corporation, Waynesboro, Pa.

[21] Appl. No.: 363,330

[22] Filed: Dec. 23, 1994

[51] Int. Cl.[6] ..... B24B 19/12; B24B 21/20

[52] U.S. Cl. ..... 451/307; 451/311; 451/360

[58] Field of Search ..... 451/307, 297, 451/296, 311, 303, 62, 360, 363

[56] References Cited

U.S. PATENT DOCUMENTS

| | | | |
|---|---|---|---|
| 3,354,588 | 11/1967 | Roehrig | 451/303 |
| 5,359,813 | 11/1994 | Kaiser, Jr. et al. | 451/285 |
| 5,367,866 | 11/1994 | Phillips | 451/303 |
| 5,371,973 | 12/1994 | Kaiser, Jr. et al. | 451/307 |

*Primary Examiner*—Robert A. Rose

*Attorney, Agent, or Firm*—Hoffman, Wasson & Gitler

[57] ABSTRACT

A tapered bearing for the drive drum assembly of a belt grinding machine that employs multiple, parallel, abrasive grinding belts, and back-up shoes for pressing the belts against the surfaces on a workpiece to be ground. The drive drum assembly, in cooperation with small pulleys operatively associated with the contouring head, keeps the abrasive belts properly trained. The central shaft of the drive drum assembly, which has a plurality of large pulleys and spacers positioned therealong, is secured between a fixed bearing support and a laterally movable support bracket. A tapered bearing is fastened to one end of the central shaft, and a complementary shaped aperture is defined in a spindle retained in the movable support bracket. When the movable support bracket is shifted inwardly, by the hydraulic circuitry of the grinding machine, the tapered bearing fits snugly into the aperture so that the drive drum assembly is supported in a rigid, sag-free manner. The snug fit "preloads" the drive drum assembly and bearing assembly, so that such assemblies rotate smoothly, without slippage, when the drive belt delivers power to the drive drum assembly. Seals are provided about the tapered bearing so that dust and debris cannot degrade the bearing, and the bearing does not wear excessively, even under prolonged, high speed operation.

4 Claims, 12 Drawing Sheets

TAPERED BEARING FOR DRIVE DRUM ASSEMBLY OF GRINDING MACHINE UTILIZING MULTIPLE, PARALLEL ABRASIVE BELTS

FIELD OF THE INVENTION

The instant invention relates generally to a drive drum assembly for retaining several abrasive belts, in parallel, for simultaneously grinding several surfaces on cylindrical work-pieces, such as multiple lobes on a camshaft, diameters on a crankshaft, or the like. More particularly, the invention pertains to a tapered bearing for the drive drum assembly that is easily engaged with a complementary aperture in a support bracket to maintain the drive drum assembly in a precisely aligned relationship.

BACKGROUND OF THE INVENTION

Grinding cam lobes on a cam shaft has usually been achieved by a grinding wheel, which grinds each cam in sequence. In some instances, by resort to complex mechanical machines with two grinding heads, a pair of cams may be ground concurrently.

In response to the needs of automotive manufacturers, in particular, efforts have been made to devise and develop, a reliable grinding machine that will grind, simultaneously, a number of or all of the cams, or lobes, on a camshaft. Since camshafts are a costly and complex article of manufacture, and since the costs of manufacturing same are significant, diverse approaches have been considered to move, technically, beyond the well known techniques relying upon grinding wheels.

One alternative approach has focused upon the use of abrasive grinding belts in lieu of the conventional grinding wheel. Such approach has considerable potential, for several belts may be utilized, in side-by-side relationship, to grind the several lobes on a camshaft simultaneously. Also, the belts, if mass-produced, will be much lower in cost, and can be discarded, after usage for an extended period of time.

Abrasive grinding belts may have been initially used in Italy ten or more years ago to grind camshafts as illustrated in U.S. Pat. No. 4,175,358, granted Nov. 27, 1979, to Ido Boscheri, which discloses a plunge grinding machine employing several abrasive belts to simultaneously grind all of the cams which are present on a timing shaft for an engine. Such grinding machine includes a massive baseplate (10) which carries a table (12) which can be reciprocated (by jacks 13) with respect to the baseplate, a tail stock and head stock mounted on the table and adapted to support the camshaft (19) to be ground, and a stationary crosspiece (22) carrying a plurality of machining units. Each machining unit comprises a supporting member (31), front and rear heads (32, 33), an abrasive belt (36), jack (43), etc. that are driven by a sensing roller (42) operatively associated with a pattern piece (18) from which the workpiece (cam) to be ground is copied. Separate drive motors (15, 25) are connected through appropriate gear transmissions and couplings so that the workpiece to be ground, and the pattern piece, are rotated in the proper phase relationship.

U.S. Pat. No. 4,833,834, granted May 30, 1989, to Henry B. Patterson et al, discloses several embodiments of multiple belt camshaft grinding machines. Each grinding machine has several grinding belts (28) and a drive (such as main drive pulley 30) therefor, and contouring shoes (35) and support members (pushrods 43) carried on a feed table (12) for separate control of cam contouring and grinding feed rate. The camshaft workpiece (20) is carried on a fixed axis by a table (16) providing axial motion for belt wear balancing oscillation. The grinding operations may be controlled by master cams, as in the embodiment of FIGS. 1 and 2, or may be numerically controlled, as in the embodiments of FIGS. 3 and 6–10.

U.S. Pat. No. 4,945,683, granted Aug. 7, 1990 to James D. Phillips, discloses an apparatus for grinding, to a predetermined contour, a plurality of eccentric cams (L) on a camshaft (W). The apparatus comprises several abrasive belts (58) supported adjacent the cam shaft for linear movement, such that the belts grind the peripheries of the cams (as shown in FIGS. 1 and 8). The belts are guided along a variable path, according to the cam contour desired, by shoes (72) engaging the belts at their point of contact with the cams. The shoes are mounted on actuators (76) powered by motor units (78) controlled by CNC controllers. Each belt passes through a coolant distributor (130) so that coolant saturates each belt and conditions same for better abrading action. The pressure of fluid within each distributor causes the belt to flex, and compensates for the tendency of the belt to stretch as the shoe 72 moves in and out.

U.S. Pat. No. 5,142,827, granted Sep. 1, 1992, to James D. Phillips, discloses a crank pin grinder employing multiple abrasive belts.

The latter three patents reflect the increasing interest in grinding machines employing several abrasive belts, side by side, to grind all of the surfaces, on a workpiece. The market potential available to the manufacturer of a commercially acceptable grinding machine that employs abrasive grinding belts is significant.

The majority of the deficiencies of the foregoing prior art multiple belt grinding machines were addressed, and resolved, by the multiple belt grinding machines disclosed in U.S. patent application Ser. No. 07/953,798, now U.S. Pat. No. 5,359,813, and application Ser. No. 07/953,799, filed Sep. 30, 1992, and presently pending. Such multiple belt grinding machines were characterized, inter alia, by long-lived, endless, abrasive belts that were easily installed, and, when necessary, removed and/or replaced. The grinding machines allowed ready access to the endless belts at two locations spaced along one side of the machine.

At one location, the outboard support bracket for the drive drum assembly is moved laterally, a significant distance, to expose the multiple belts. At a second location, a rotary actuator, with a locking arm, is pivoted through an arc, which may be 45°, to reveal the multiple belts affixed to the underside of the contouring head assembly, at the front thereof.

Whereas the drive drum assembly disclosed in U.S. patent application Ser. Nos. 07/953,798 (now U.S. Pat. No. 5,359,813), and 07/953,799, filed Sep. 30, 1992, and both assigned to the assignee of record, Western Atlas Inc., functioned satisfactory, prolonged usage of the multiple belt grinding machines indicated that refinements in the drive drum assembly were desirable. Occasionally, in the field, operators noted chatter and/or vibrations between the central shaft of the drive drum assembly and the corresponding aperture in the movable outboard support that receives one end of the central shaft of the drive drum assembly. The central shaft is supported at the opposite end-by a fixed bearing support.

Such relationships are shown in FIG. 4 of the two applications noted above, wherein the projecting nose is identified by reference numeral **148*a*, and the central shaft for the drive drum is identified by reference numeral 148. The laterally movable support bracket is indicated by reference numeral 142, the fixed support bearing is indicated by reference numeral 160, and the drive drum assembly is indicated by reference numeral 100**.

The projecting nose 148*a* has a series of flats formed above its periphery. The outer diameter of projecting nose (148*a*) has a clearance fit with the inner diameter of a spindle in the outboard support bracket (142) to permit engagement, thus creating the possibility of slippage and/or radial shake during operation. Consequently, when the drive belt (104) delivers power to one end of central shaft (148), the radial clearance between the flats and the aperture causes slippage. Also, the central shaft exhibited a tendency to sag, a minute fraction of an inch, in cantilever fashion, due to the loads imposed thereon. While the sagging problem, and/or the slippage problem would normally be minor problems, such problems take on far greater significance when viewed in the context of a high precision, multiple belt, grinding machine, for grinding workpieces with differently shaped surfaces within exceedingly close tolerances. Also, the sagging and/or slippage problems contribute to poor wear characteristics for key components of the grinding machine.

SUMMARY OF THE INVENTION

Consequently, to address these problems, the instant invention employs a tapered bearing secured to the end of the central shaft that fits within a complementary shaped aperture defined in an end cap retained in the outboard support bracket. The outboard support bracket is movable laterally so that the end cap securely engages the tapered bearing, and the drive drum assembly is retained in fixed position between the outboard support bracket and the (inboard) fixed support bracket.

Such secure engagement precludes sag in the central shaft even though the drive shaft extends in cantilever fashion from one fixed support, and despite the stresses and strains imparted thereto by the machining operations performed by the multiple abrasive belts. A ball bearing assembly insures that the spindle rotates smoothly within the outboard support bracket in response to the driving force imparted to the central shaft of the drive drum assembly. Seals are operatively associated with the tapered bearing and the end cap to keep metal chips, dust, debris, etc. from entering the bearing assembly and degrading same.

The unique tapered bearing, and its related components, also facilitate the disengagement of the laterally movable support bracket from the central drive shaft, so that the abrasive belts can be accessed for inspection, repair, or replacement. After servicing the abrasive belts, the movable support bracket is shifted, under hydraulic control, to return to its operative position, wherein the central shaft of the drive assembly is fully supported.

The tapered bearing enters a complementary socket defined in the movable support bracket; the bearing and the socket cooperate to impart a pre-load to the drive shaft and the ball bearing assembly. The pre-load eliminates slippage and clearance between the components of the drive belt assembly at all times, including start-up operation.

In addition to facilitating the servicing of the abrasive belts, the instant invention increases the "stiffness" of the entire grinding machine to a level of rigidity unobtainable with known multiple belt grinding machines. Numerous other advantages attributable to the instant invention will occur to the skilled artisan, when the appended drawings are construed in harmony with the ensuing specification.

DETAILED DESCRIPTION OF THE INVENTION

Figure 1:
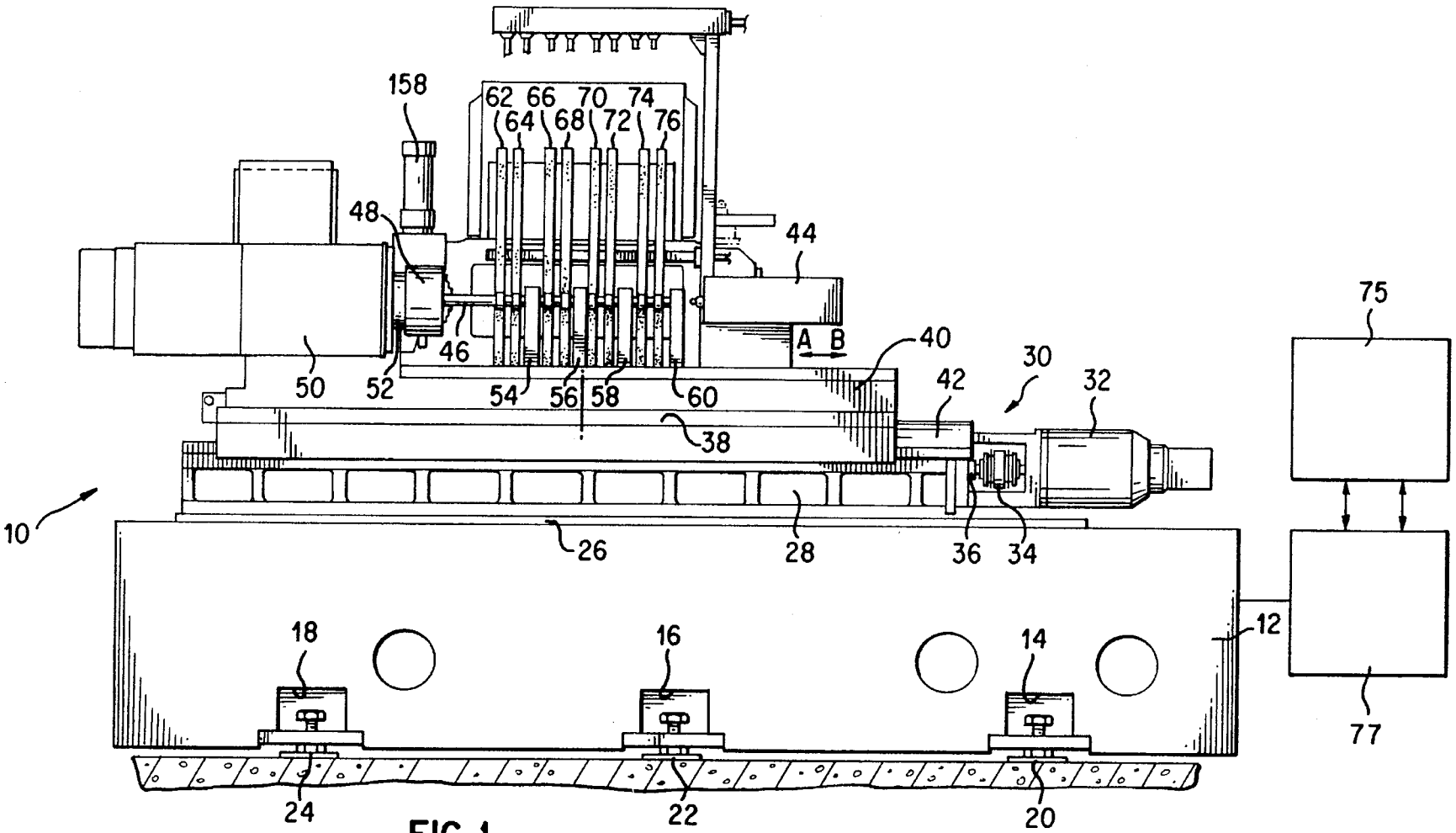
FIG. 1 is a front elevational view of a grinding machine employing several abrasive belts disposed to simultaneously grind multiple lobes on a camshaft, such machine being constructed in accordance with the principles of the instant invention.

FIG. 1 is a front elevational view of a grinding machine 10 constructed in accordance with the principles of the present invention. Machine 10 includes a massive, metal bed 12 that may be filled with concrete or similar material. Cavities 14, 16, 18 are defined in the front face of bed 12, and stabilizers 20, 22, and 24 are situated within the cavities. The stabilizers establish a level plane for the grinding machine 10, despite imperfections in the floor of the factory. Additional stabilizers are situated in additional cavities spaced about the sides, and rear face, of the bed.

Pad 26 extends transversely across machine 10, and metal base 28 is bolted to pad 26. A carriage traverse assembly, indicated generally by reference numeral 30, drives carriage 38 along base 28 to position the workpiece to be ground in alignment with the grinding belts.

Carriage traverse assembly 30 includes motor 32, coupling 34, and lead screw mechanism 36. Coupling 34 enables the motor to deliver rotational force to the lead screw mechanism 36, despite shaft misalignments, and the lead screw mechanism translates such force into linear motion which moves carriage 38 along base 28 in the direction of arrows A and B. Swivel table 40 is secured atop carriage 38, and moves in concert with the carriage. A cover 42 is secured to one side of carriage 38, and extends laterally to prevent debris from entering the narrow gap defined between carriage 38 and base 28; bearings and lubricating fluid fit within the narrow gap (not visible in FIG. 1) to insure smooth, and precise, movement of carriage 38. A second cover is secured to the opposite end of the carriage.

Tailstock 44 is secured to swivel table 40 by a dovetail connection; tailstock 44 is movable laterally along swivel table 40, as indicated by the directional arrows A and B.

Tailstock 44 is shown in FIG. 1 spaced a small distance from the right hand end of the workpiece, in this instance a camshaft 46. Alternatively, if warranted, tailstock 44 can be moved into engagement with the end of the workpiece, such as camshaft 46. The opposite end of camshaft 46 is retained within chuck 48 on headstock 50; an integral motor rotates spindle 52 and chuck 48, which supports the end of camshaft 46 during grinding operations.

Spaced work holders 54, 56, 58, and 60 grasp bearings on the camshaft. The bearings cooperate with the headstock 50 and tailstock 44 to retain the camshaft 46 in a proper position relative to grinding belts 62, 64; 66, 68; 70, 72; and 74, 76.

A programmable controller 75 (FIG. 1) of conventional construction cooperates with various electrical hydraulic mechanisms, sensing devices, and controls of machine 10 through a control unit 77 to receive signals therefrom and transmit control signals thereto to operate the motors, prime movers, hydraulic and fluid operated and other devices of machine 10.

Figure 2:
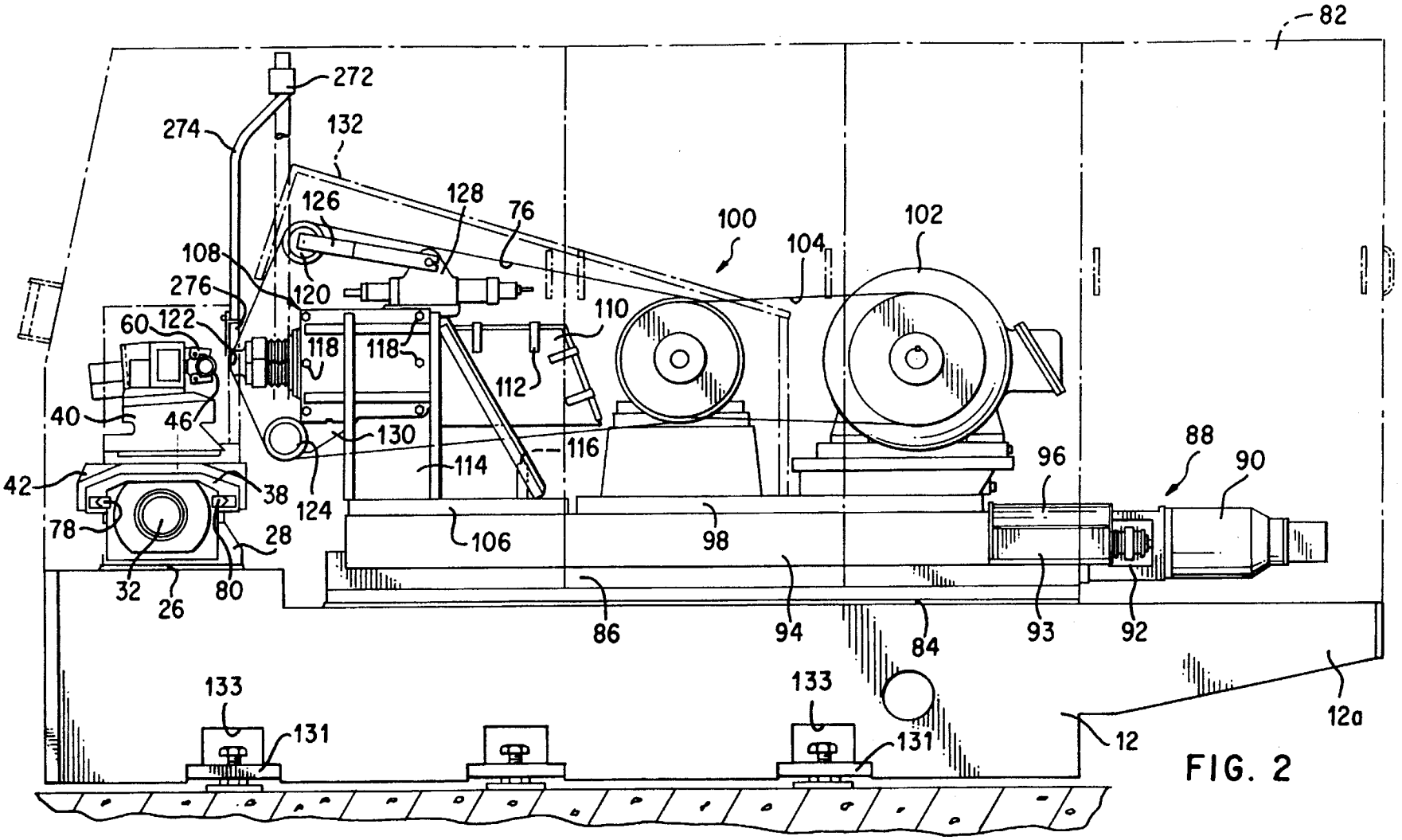
FIG. 2 is a side elevational view of the grinding machine shown in FIG. 1, such view being taken on the right side of the machine.

FIG. 2 shows additional details of carriage traverse assembly 30. For example, linear guide rails 78, 80 are situated between the inturned flanges of movable carriage 38 and base 28, and the outline of swivel table 40, is visible. Also, FIG. 2 shows that pad 26 is situated on the shoulder of bed 12, at a higher elevation than the remainder of bed 12. A cabinet 82, shown in phantom outline, surrounds the grinding machine; the lower end of the cabinet enclosure is seated in a trough (not shown) at the upper end of bed 12.

A second pad 84 extends along the longitudinal axis of machine 20, and projects above the upper edge of bed 12. A second base 86 is secured to pad 84, and extends along the longitudinal axis of the machine. A positioning slide feed assembly 88, which is configured in much the same manner as carriage traverse assembly 30, and functions in a similar manner, is indicated generally by reference numeral 88.

Figure 14:
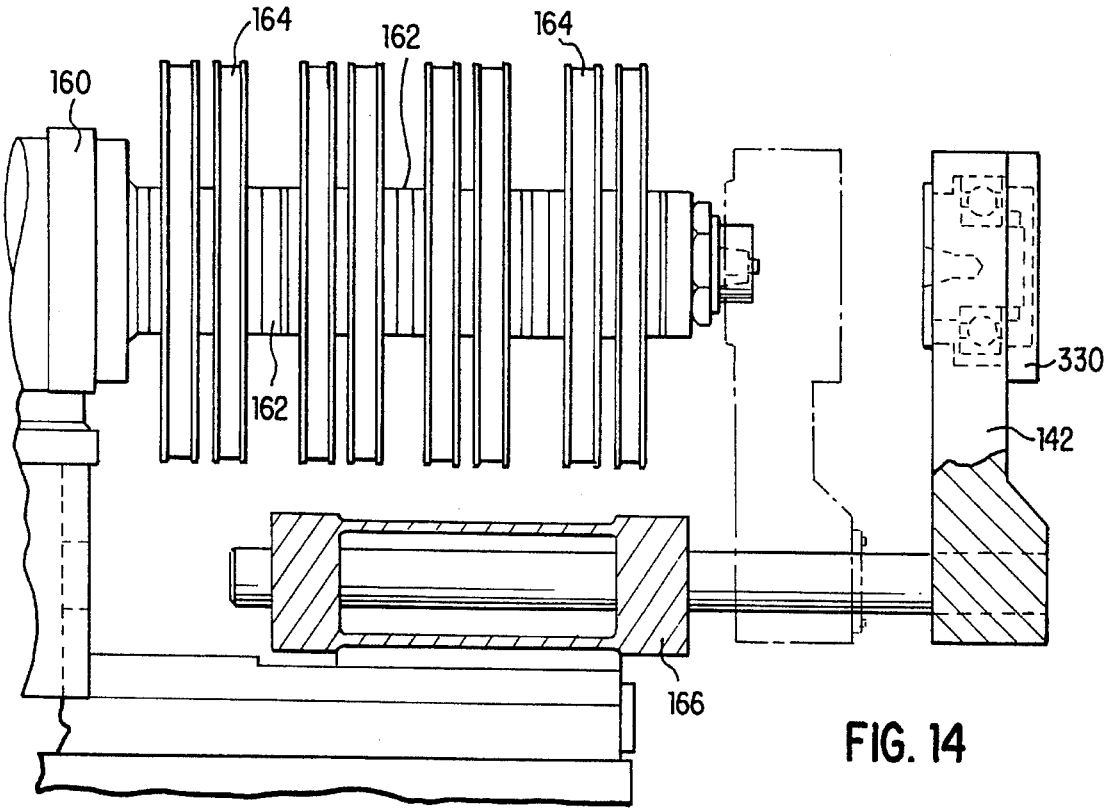
FIG. 14 is a rear elevational view of the mechanism for shifting the outboard bracket of the drive drum assembly, such vie being taken along line XIV—XIV in FIG. 13 and in the direction indicated.

Positioning slide feed assembly 88 includes motor 90, flexible coupling 92, and lead screw mechanism 93. Lead screw mechanism 93 advances, or retracts, positioning slide 94 along second base 86, which extends along the longitudinal axis of machine 10. Coupling 92 transmits rotational force from motor 90 to positioning slide 94 via lead screw mechanism 93, that is shielded from view in FIG. 2 by cover 96 (but shown in FIG. 14, and discussed at a later juncture in the specification).

Positioning slide feed assembly, and carriage traverse assembly 30, are formed of identical components. Consequently, the number of spare parts needed to maintain the grinding machine in operative condition is reduced, with attendant savings in part manufacture, installation and maintenance.

Drive base 98 is situated atop positioning slide 94, and supports drive drum assembly 100 and prime mover 102. In this instance, prime mover 102 is an electric motor suitably powered and controlled, for supplying motive power, via endless drive belt 104, to drive drum assembly 100.

Support base 106 is also situated atop positioning slide 94, but is spaced a short distance away from drive base 98. Support base 106, and drive base 98, also extend transversely across positioning slide 94. While support base 106 is fixed to positioning slide 94, drive base 98, and the components resting upon the drive base, may be adjusted longitudinally, by a distance of a fraction of an inch relative to positioning slide 94. The contouring feed assembly, indicated generally by reference numeral 108, is mounted atop support base 106. A protective enclosure 110 is secured to the rear end of the contouring head assembly, and manually operable clamps 112 and screws provide access to the interior of the enclosure, when necessary.

Standard 114 extends upwardly from the right side of support base 106, and an angularly oriented brace 116 rigidifies the standard. Base 106, standard 114, and brace 116, are formed as a unitary weldment for enhanced stability and rigidity. Contouring head assembly 108 is secured to standard 114 by bolts 118.

The path of travel for abrasive belt 76 is shown in FIG. 2, and the several other abrasive belts are entrained, in parallel fashion, in a similar manner. Belt 76 passes about a drum on drive drum assembly 100, travels about pulley 120, over curved back-up shoe 122, passes over pulley 124, and returns to the drive drum assembly. Pulley 120 is secured to the free end of arm 126 that is pivotally mounted upon housing 128 that is secured to the upper surface of contouring head assembly 108. Pulley 124 is fixed by ear 130 to the front, lower corner of assembly 108.

The rear section of bed 12 situated beneath motor 90 projects upwardly and outwardly from the generally rectangular base, and forms an overhang **12*a*. Stabilizers 131 are located in cavities 133** formed in the side walls of the bed.

Figure 3:
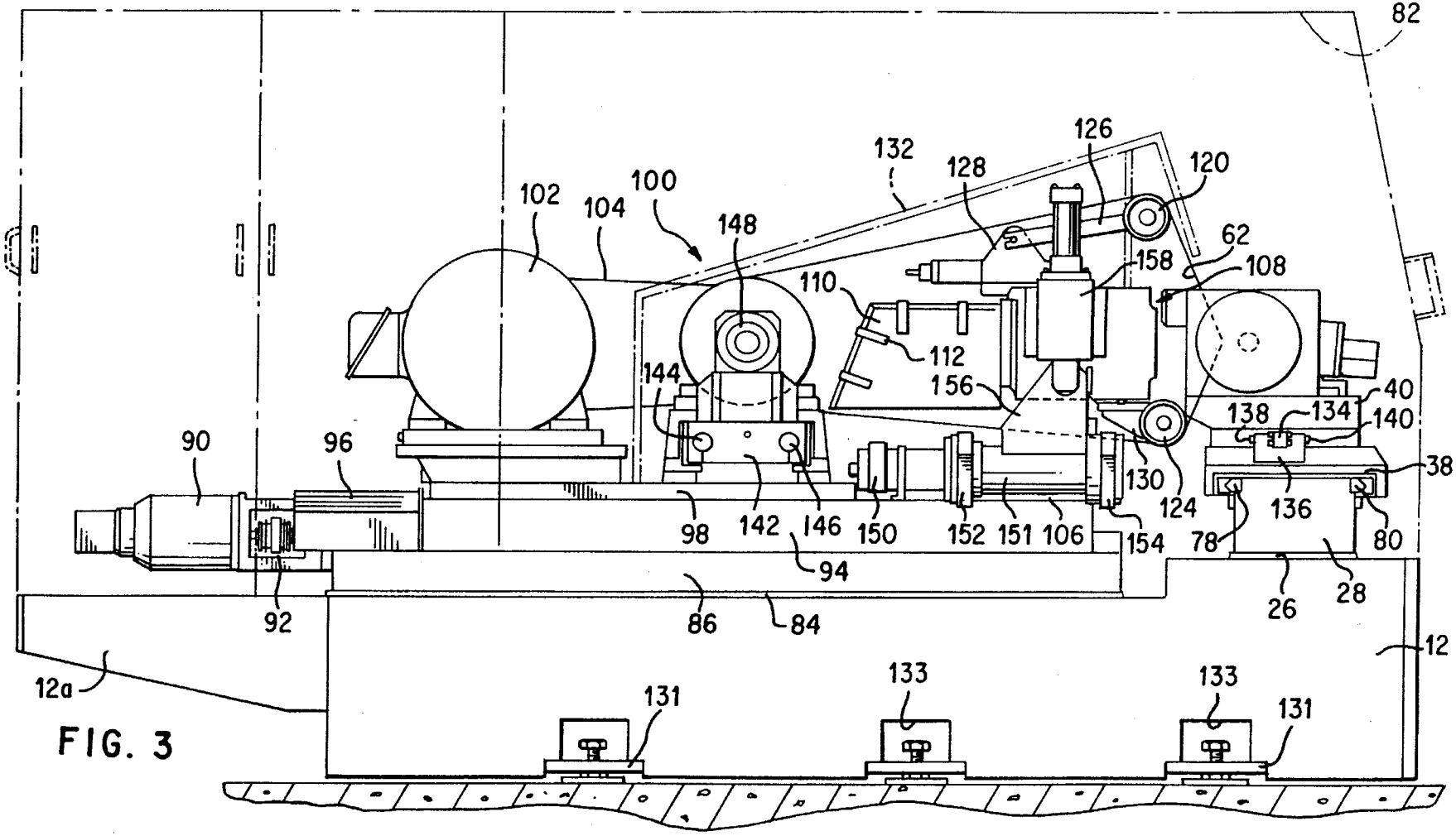
FIG. 3 is another side elevational view of the grinding machine shown in FIG. 1 such view being taken on the left side of the machine.

FIG. 3, which shows the left side of machine 10, reveals structural details not discernible in FIG. 2. Protective cover 132 reduces spattering from the fluid (coolant and/or lubricant) used during the grinding operations. A depending pin 134 on swivel table 40 extends downwardly into upwardly opening yoke 136 on carriage 38. Set screws 138, 140 can be adjusted so that the pin 134 is shifted, a fraction of an inch, within the yoke for precise alignment of table 40.

Drive drum assembly 100 includes end bracket 142, that is capable of lateral, or transverse movement, along with guide rods 144 and 146. During grinding operations, the bracket 142 supports the central shaft 148 of the drive drum assembly and is only shifted laterally, with the guide rods 144, 146, when the grinding operations have been terminated, and access to the abrasive belts is needed.

A hydraulic motor 150 is secured to base 106, and is connected to pivotable shaft 151, via couplings (not shown). Pivotable shaft 151 is mounted within bushings 152, 154. An arm 156 is secured to pivoting shaft 151 and is driven thereby. The operation of hydraulic motor 150 thus controls the pivotal movement of arm 156. A hydraulic cylinder 158 is secured to the side of contouring head assembly 108, in operative relationship to arm 156.

Figure 4:
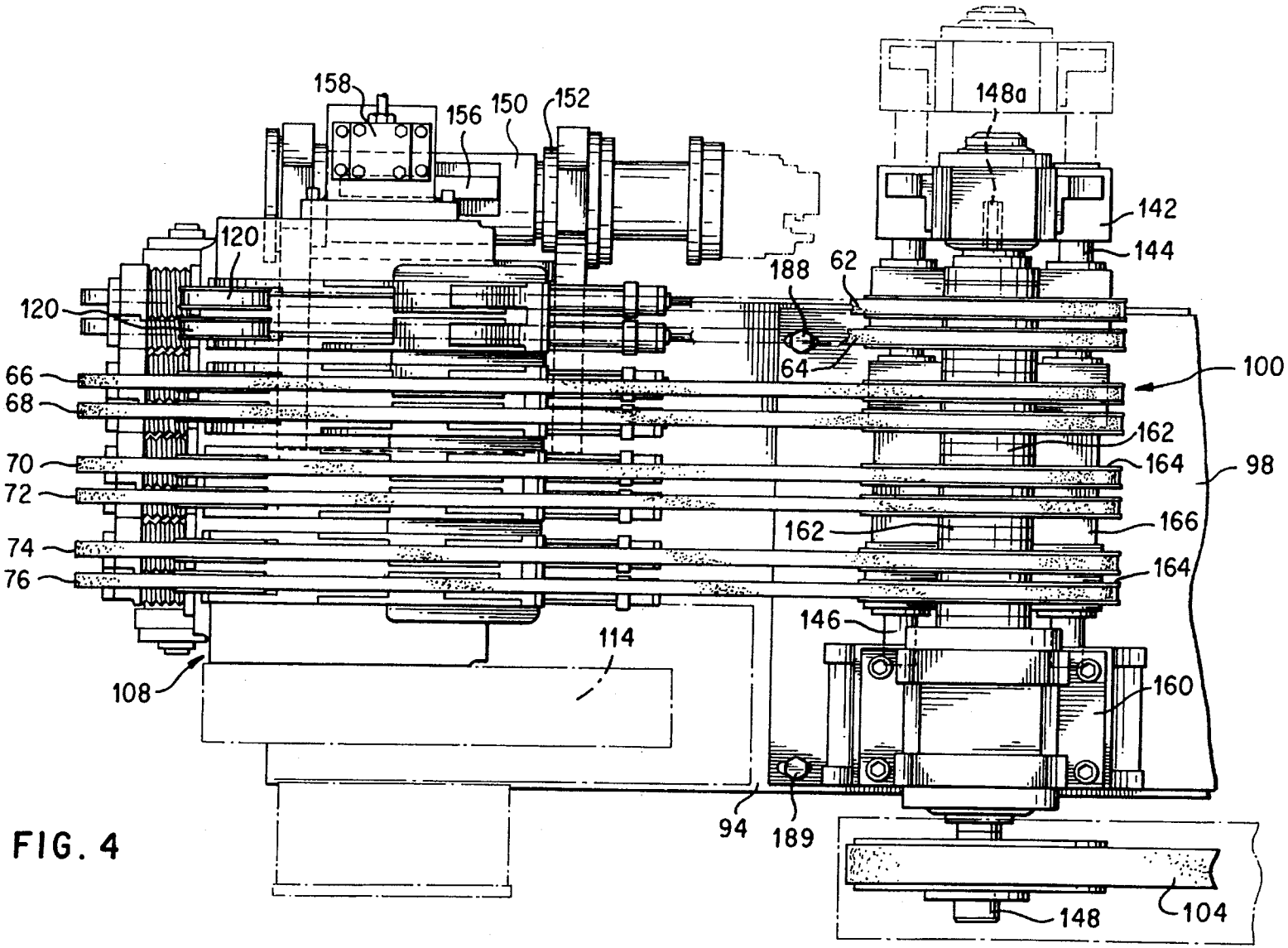
FIG. 4 is a fragmentary, top plan view of the grinding machine shown in FIG. 1, with the camshaft to be ground omitted for the sake of clarity.

FIG. 4 shows that drive drum assembly 100 includes a central shaft 148 that extends laterally across drive base 98 and underlying positioning slide 94. Shaft 148 extends between fixed bearing support 160 and laterally movable end bracket 142 at opposite sides of base 98. A projecting nose 148*a* is locked within outboard support bracket 142, when machine 10 is operating. Bracket 142, along with guide rods 144, 146, are shifted laterally by a hydraulic cylinder, to a retracted position shown in dotted outline. In the retracted position, the operator may gain ready access to the several parallel abrasive belts 66, 68, 70, 72, 74 and 76. Fragmentary portions of abrasive belts 62, 64 are shown. The fragmentary views of belts 62, 64, and the omission of the camshaft 46 to be ground by the abrasive belts, enhance the clarity of FIG. 4.

Spacers 162 are slid onto central shaft 148 to position large pulleys 164 therealong, at spaced intervals. Large pulleys, or drums, 164 may be crowned slightly (not shown) to enhance the tracking of the abrasive belts over the pulleys, and the pulleys have raised side walls to prevent the abrasive belts from slipping sidewards. Rotational power is imparted to shaft 148, and the pulleys 164 positioned thereon, by drive belt 104; only a fragment of the drive belt 104 is visible in FIG. 4.

Guide rods 144 and 146 extend through a guide block 166 that is situated between fixed bearing support 160 and outboard support bracket 142. When it is necessary, or desirable, to inspect, service, and/or replace one or more of the set of abrasive belts, bracket 142, and the guide rods 144, 146, are shifted laterally to the disengaged position shown by the dotted outline in FIG. 4. Access is then afforded to inspect, service, repair and/or replace the abrasive belts, as necessary. Such ready access to the abrasive belts reduces operating expenses by minimizing down-time for maintenance and/or replacement.

Drive drum assembly 100 is mounted upon positioning drive base 98, which moves longitudinally with positioning slide 94, under the control of motor 90 at the rear of the machine. Drive drum assembly 100 extends laterally across drive base 98, as shown in FIG. 4.

Figure 6:
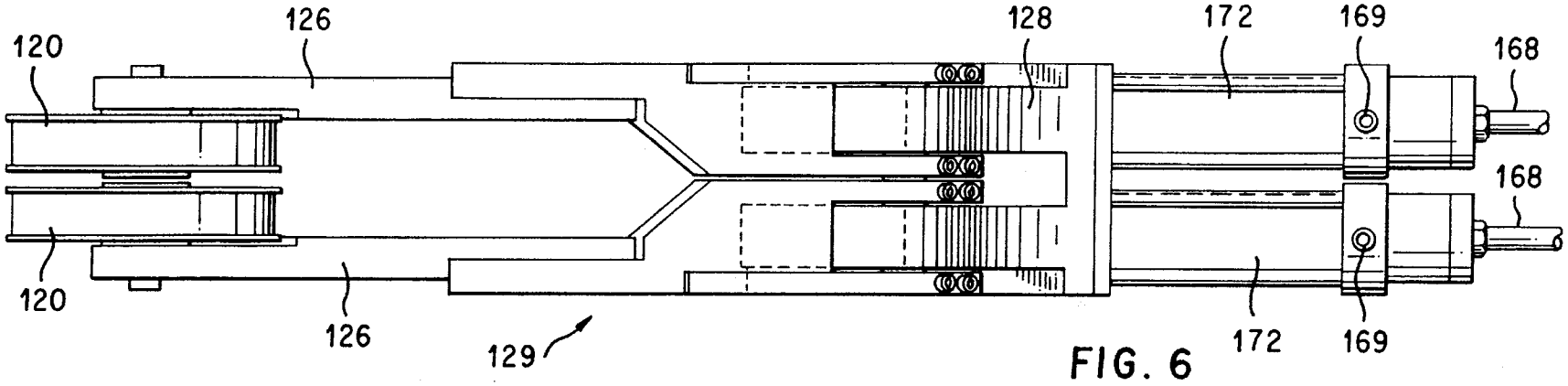
FIG. 6 is a top plan view, on the same scale as FIG. 5 of the belt tensioning mechanism.
Figure 5:
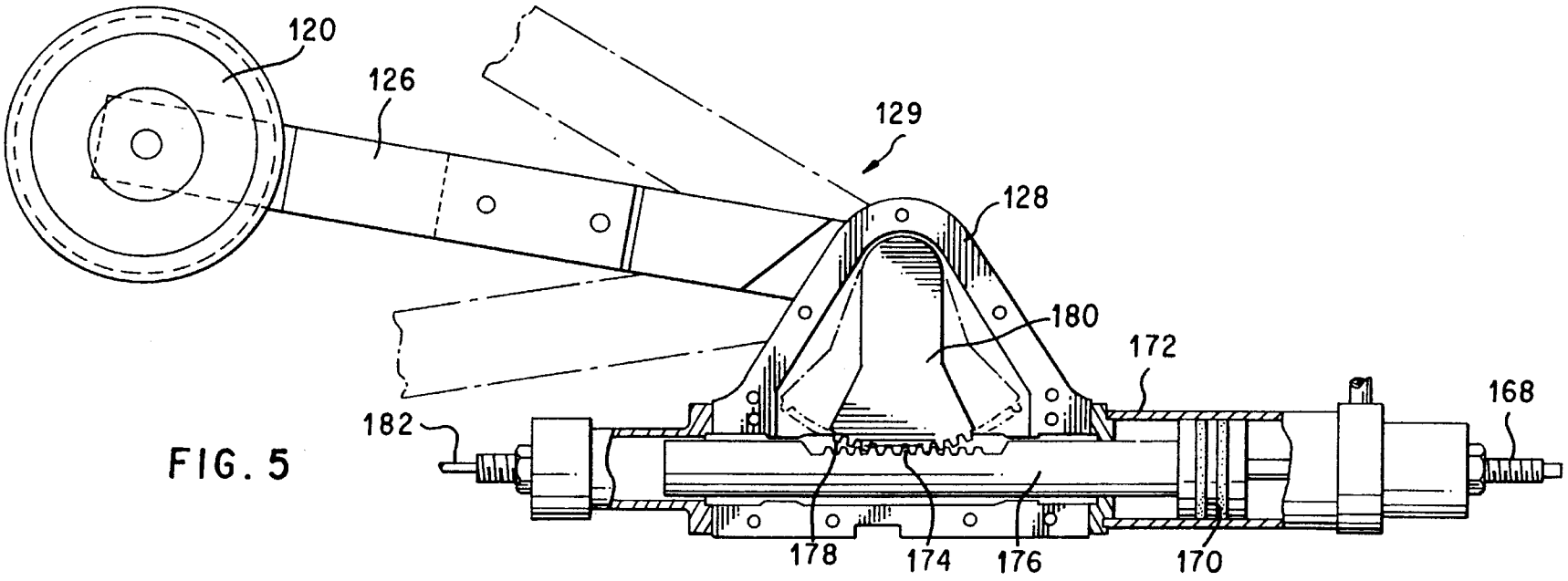
FIG. 5 is a side elevational view of the belt tensioning mechanism, on an enlarged scale, with sections broken away.

FIGS. 5 and 6 show the details of a tensioning mechanism 129 for adjusting, and maintaining, the tension on one of the endless abrasive belts employed within machine 10. Each abrasive belt is tensioned in the same manner as respective tensioning mechanism 129, and so only one mechanism 129 will be described in detail. Adjustment screw 168 is manipulated to establish a tension on a spring (not shown) disposed within housing 128 and operatively associated with piston 170. Pneumatic pressure is supplied to inlet port 169 from a suitable source and under a control to be subsequently described, and urges piston 170 to move axially within cylinder 172. A gear rack 174 is situated on the upper surface of piston rod 176, and the teeth 178 on pivotably mounted sector gear 180 mesh with the gear rack. Sector gear 180 is secured to the inner end of arm 126, such that the movement of sector gear 180 adjusts the position of arm 126 and pulley 120 secured to the free end of the arm. Consequently, by increasing the pressure at inlet port 169, and adjusting the tension in the spring, pulley 120 is pivoted clockwise to increase the tension in the abrasive belt passing thereover. A proximity switch 182 is located at the end of housing 128 remote from adjustment screw 168. When an abrasive belt breaks, arm 126 pivots clockwise and the end of rod 176 approaches, or contacts, switch 182, thus sending a warning signal to the machine operator.

Figure 7:
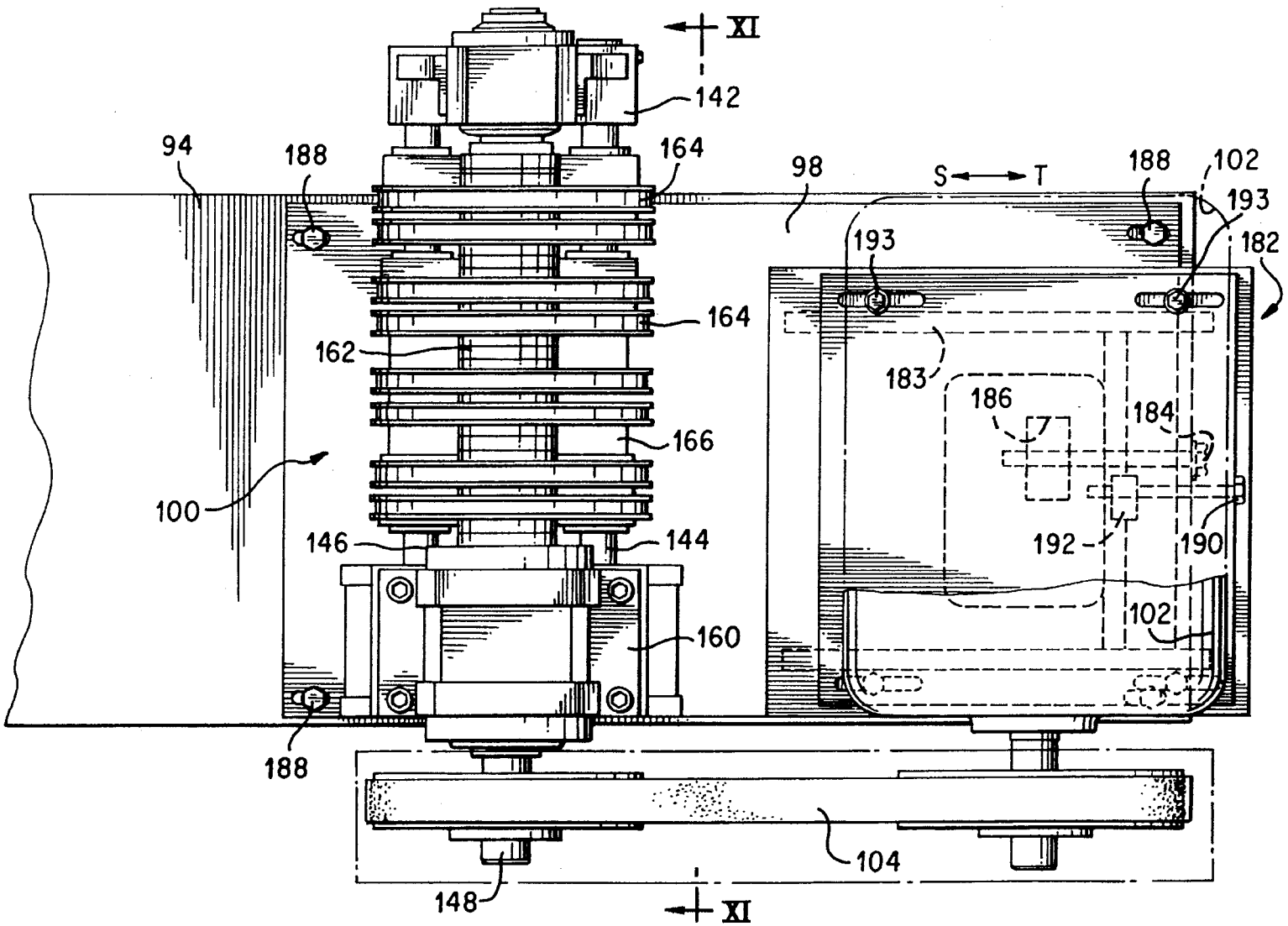
FIG. 7 is a fragmentary, top plan view of the grinding machine of FIG. 1, showing adjustment mechanisms.

FIG. 7 shows that drive drum assembly 100 and electric motor 102 are both mounted upon drive base 98, which, in turn, is positioned atop positioning slide 94. A pedestal 183 comprising a pair of plate-like members and vertical stand-offs support the prime mover. The outlines of the stand-offs are shown in dotted outline in FIG. 7.

Electric motor 102 may be shifted longitudinally in the direction of arrows S-T, a short distance along drive base 98 to adjust the tension in drive belt 104. A bolt 184 cooperates with a first follower 186 mounted to drive base 98 to exert sufficient force on prime mover 102 to shift same longitudinally. A pin and slot mechanism (not shown) enables the movement of the prime mover relative to the drive drum assembly 100, while maintaining a substantially parallel relationship. After the prime mover has been shifted longitudinally, clamping bolts 193 are tightened within slots in the pedestal to maintain the adjusted position.

Also, due to variances in the circumference, or length, of the endless abrasive belts, which are approximately 132 inches in length, adjustment may be required beyond that obtainable with the adjustment of arms 126 of tensioning mechanism 129 (shown in FIGS. 5 and 6). For such purpose, second bolt 190 and second follower 192 are provided. By rotating second bolt 190, drive base 98 and the components mounted thereon are shifted longitudinally, as a unit, to compensate for variances in the circumference of the abrasive belts passing over the large pulleys 164 of the drive drum assembly 100. Once again, the actual movement of drive base 98 relative to positioning slide 94 occurs through a second pin-and-slot connection (not shown). Clamping bolts 188 are then tightened to maintain the adjusted position of the drive base.

Figure 8:
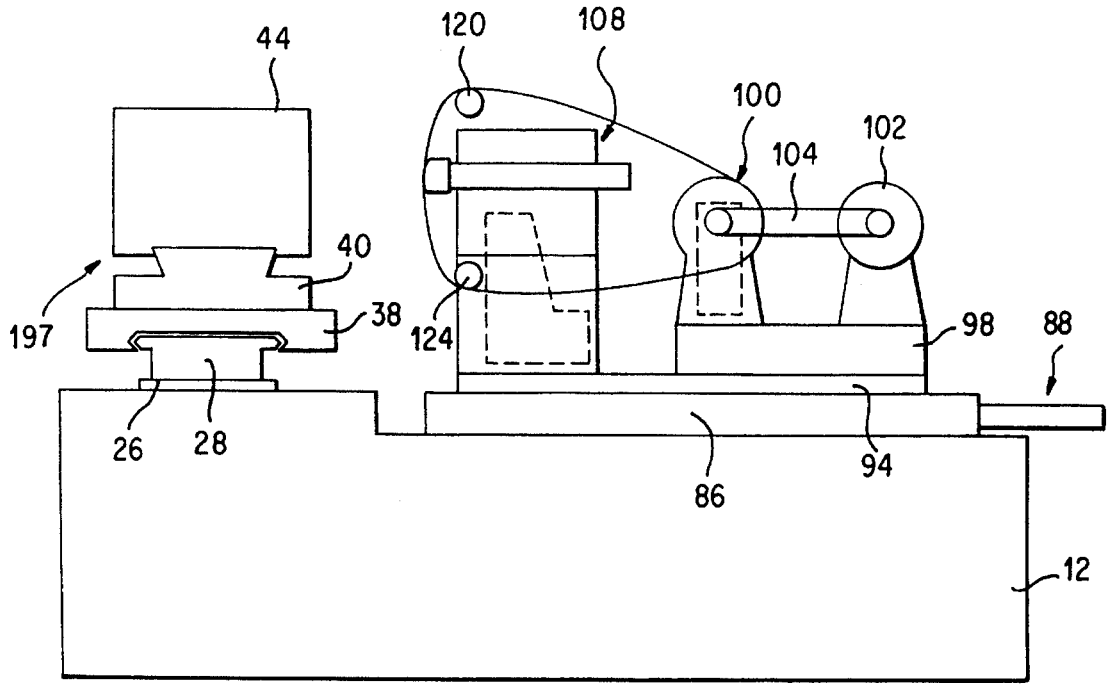
FIG. 8 is a schematic diagram correlating the carriage slide assembly, the positioning slide feed assembly, the contouring head assembly, and the mechanism for training an abrasive belt.

FIG. 8 schematically interrelates the carriage 38, swivel table 40,and tailstock 44, which may be considered as a carriage assembly 197, and positioning slide 94, and the several components supported thereon. Such assemblies move along perpendicular axes to bring the workpiece and the contouring head assembly, with its multiple, parallel abrasive belts, into alignment.

FIG. 8 shows that traversing carriage assembly 197 moves relative to fixed base 28 that is bolted to pad 26 on the bed 12 of the machine. Tailstock 44 is secured to swivel table 40 by a dovetail connection. Swivel table 40 carries headstock 50, workholders 54, 56, 58, 60 and cam shaft 46.

Positioning slide 94 longitudinally advances the contouring head assembly 108, with its multiple abrasive belts and contouring feed units, into position to grind the lobes on the camshaft 46. Positioning slide 94 moves along second base 86, which is also bolted to bed 12 of machine 10. Second base 86 is fixed, or bolted into fixed position, and performs a support function similar to that of first base 28. Motor 90, flexible coupling 92, etc. are omitted from FIG. 8, but such components deliver sufficient force to positioning slide 94 to advance, or retract, same along second base 86.

Drive base 98, which supports electric motor 102 and drive drum assembly 100, rests atop positioning slide 94. Drive belt 104 delivers power from electric motor 102 to drive drum assembly 100. Several abrasive belts are trained over the several large pulleys within drive drum assembly 100 and electric motor 102 empowers such abrasive belts via drive belt 104.

Contouring head assembly 108 is integral with positioning slide 94. Pulleys 120, 124 are respectively secured above, and below, the front of contouring head assembly 108, and define the path of travel for the abrasive belts.

Figure 9:
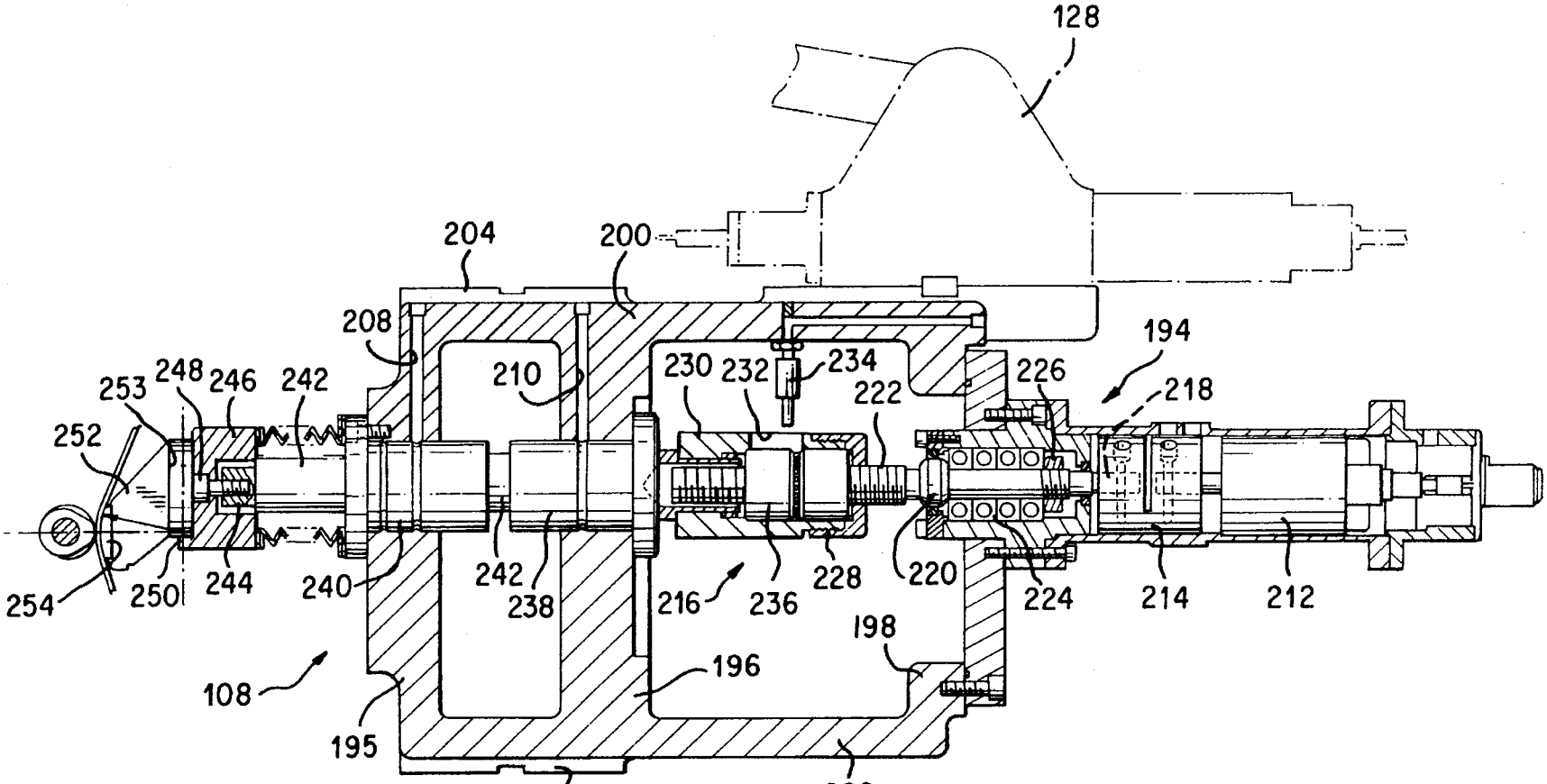
FIG. 9 is a side elevational view of a contouring feed unit employed within the grinding machine shown in FIG. 1.

FIG. 9 shows a representative contouring feed unit 194. Contouring head assembly 108 includes several identical contouring feed units 194. Contouring head assembly 108 includes a sturdy metal frame including front wall 195, intermediate wall 196, rear wall 198 with an access opening, top 200, and bottom 202. First pads 204 may be disposed along top 200, and second pads 206 are disposed on bottom 202 of the contouring head assembly 108. The pads serve as reference points in the assembly, and alignment, of the various components of the contouring head assembly. First lubrication channel 208 extends downwardly through front wall 195, and second lubrication channel 210 extends downwardly through intermediate wall 196.

Contouring feed unit 194 includes drive motor 212, which may be a brushless servo-motor, coupling 214, and roller screw mechanism 216. Coupling 214 receives, and retains, the output shaft of motor 212 and elongated shaft 218 of a roller-screw mechanism 216. Annulus 220 is defined on shaft 218, and the end of the shaft remote from coupling 214 cooperates with threaded shaft 222. Bearings 224 are "squeezed" between annulus 220 and bearing nut 226. Shaft 222 passes through end cap 228 of collar 230, and through internally threaded nut 236 retained within an axial bore within collar 230. Rotation of shaft 222 causes collar 230 to move axially in response to the force generated by motor 212. A slot 232 is defined in collar 230, and nozzle 234 allows lubricant to drip into the interior of collar 230 to lubricate the roller screw and nut mechanism retained within collar 230. The lubricant drips into a slot between the two halves of nut 236; the lubricant passes radially inwardly to lubricate the roller-screws retained within nut 236.

Ball spline nuts 238, 240 are positioned in bores in intermediate wall 196 and front wall 195, respectively, of contouring head assembly 108, and the shaft 242 of a ball-spline mechanism passes axially therethrough. The forward end of shaft 222 is joined to the rear of ball-spline shaft 242. Additional details of the ball-spline mechanism are not shown, since such mechanism can be purchased as an off-the-shelf item. The sleeves are fixed, and only the shaft 242 of the ball-spline mechanism can translate longitudinally. The extent of longitudinal movement of collar 230 dictates the extent of movement of shaft 242. Channels 208, 210 deliver lubricant to ball-spline nuts, or collars, 238 and 240.

The forward end of shaft 242 of the ball-spline mechanism terminates in a nose 244, and a threaded bore is drilled axially into the nose. An adaptor 246 is secured to nose 244 of shaft 242 by threaded fastener 248. A locating lip 250 projects from the front face of adaptor 246, and a base 253 of back-up shoe holder 252 is seated thereon, so that back-up shoe 254 contacts the inner surface of the abrasive belt passing thereover in a correct, and accurately located, disposition as will be hereinafter explained. The roller screw mechanism 216 thus translates the rotational driving force of motor 212 into a longitudinally directed force that can press the back-up shoe and abrasive belt very firmly against the workpiece to be ground, when such cycle of operation is dictated by the control system, including programmable controller 75 and control unit 77 for machine 10.

Figure 10:
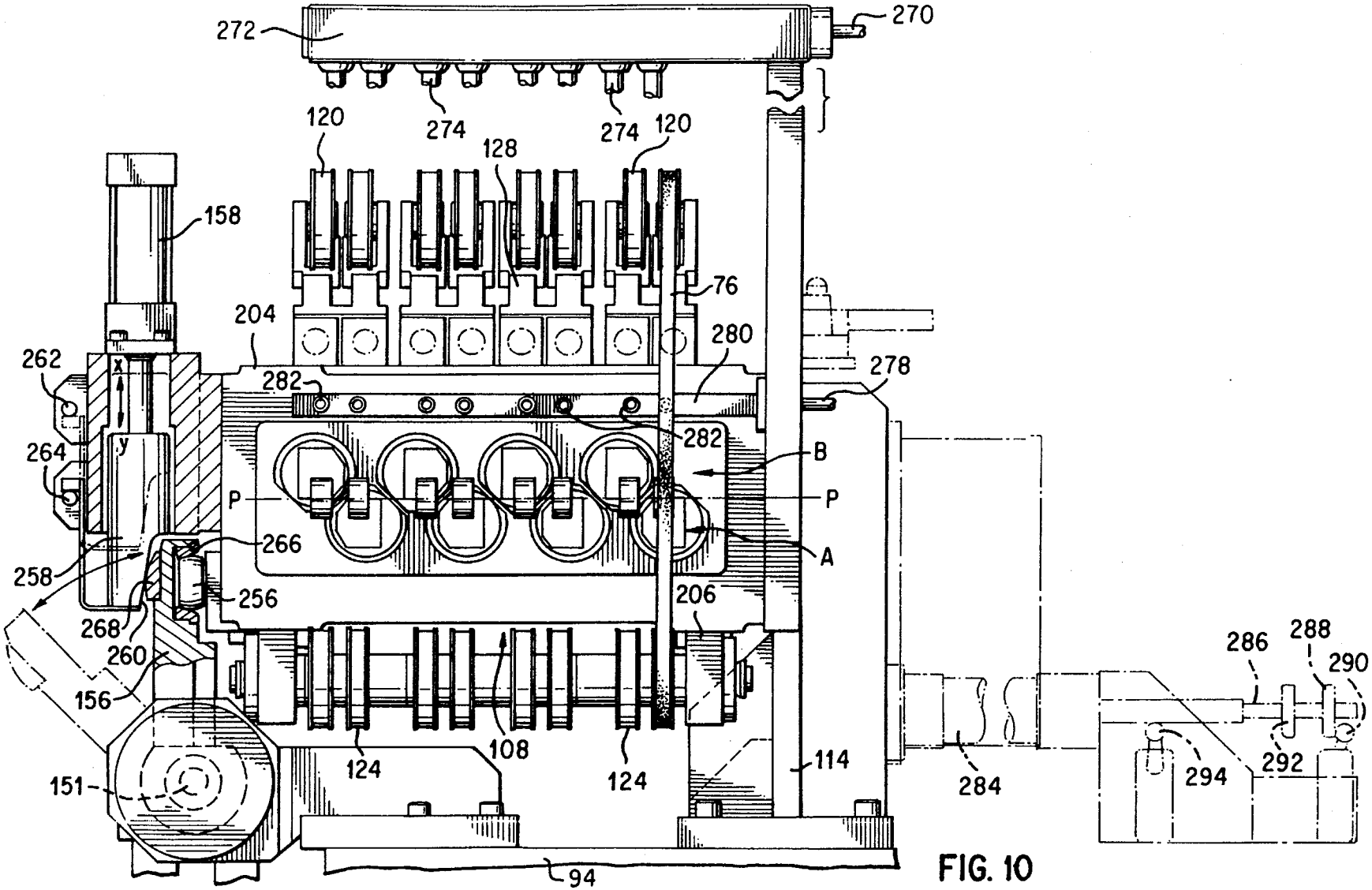
FIG. 10 is a front elevational view of the contouring head assembly, employed within the grinding machine shown in FIG. 1, and the outboard locking mechanism therefor.

FIG. 10 is a front elevational view of contouring head assembly 108, and the supporting and locking mechanisms therefor, that rigidify and strengthen such assembly. Assembly 108 is secured to positioning slide 94 and moves in concert with the slide. The right, or inboard, side of assembly 108 is bolted to standard 114, but the left, or outboard, side of assembly 108 is not similarly supported, but projects laterally in a cantilevered manner. In order to maintain the high degree of "stiffness" present throughout machine 10, and to avoid any sag, of even a minute fraction of an inch, a unique locking mechanism is utilized to support the outboard end of contouring head assembly 108.

The locking mechanism includes ball-shaped protrusion 256 on the outboard wall of assembly 108, and hydraulic cylinder 158 mounted on a stable support above the protrusion. Hydraulic cylinder 158 drives a plunger 258, with a tapered face 260, in the vertical direction; the direction of movement of the plunger is indicated by the directional arrows x and y. Switches 262, 264 detect the extended, or retracted, positions of plunger 258.

When hydraulic cylinder 158 retracts plunger 258 upwardly, hydraulic motor 150 may be energized so that arm 156 pivots to its inoperative position, shown in dotted outline, from its locking position, shown in solid lines. In its vertical, locking position, socket 266 engages protrusion 256 securely. Hydraulic cylinder 158 may then be pressurized to force plunger 258 downwardly. Tapered face 260 on the plunger slides over cam 268 secured to the upper end of arm 156; the interaction between these surfaces multiplies the "squeezing" action of the protrusion, or ball, 256 and the socket. The locking mechanism is sturdy enough to absorb any sideward thrust forces, and effectively locks the contouring head assembly in fixed position.

The vertical relationship of pulleys 120 and 124 relative to contouring head assembly 108 is shown in FIG. 10. Only abrasive belt 76 is shown trained about upper pulley 120 and lower pulley 124; the other parallel abrasive belts are omitted for the sake of clarity. In order to deliver lubricant to each abrasive belt, lubricant is introduced from a source (not shown) over conduit 270 into manifold 272; the manifold discharges the lubricant into smaller flexible pipes 274 that depend from the manifold. Each individual pipe delivers lubricant to nozzle 276 (visible in FIG. 2) that dispenses such fluid onto the outer surface of an abrasive belt to lubricate and/or cool same.

Lesser quantities of lubricant may also be discharged upon the inner surface of each abrasive belt. To obtain such objective, lubricant from a source (not shown) is delivered, via conduit 278, to minor manifold 280; metal pipes 282 of small diameter discharge the contents of manifold 280 against the inner surface of each abrasive belt.

A large hydraulic cylinder 284, with a laterally extending rod 286, is shown in dotted outline in FIG. 10. The cylinder is operatively associated with drive drum assembly 100 and is connected to control unit 77 to be operated therefor. When rod 286 is extended outwardly, as may occur when the outboard support bracket 142 for the drive drum assembly is in the operative position, ring 288 trips switch 290. When the rod is drawn inwardly by piston. 284, as when the end bracket 142 of drive drum assembly 100 is moved laterally to facilitate servicing the abrasive belts, ring 292 trips switch 294.

FIGS. 11–14 show the details of drive drum assembly 100, including the tapered bearing and the complementary aperture in the end cap, that enhance the operation of the multiple belt grinding machine. While one end of central shaft 148 is retained in fixed support bearing 160, as shown in FIG. 4, the free end of shaft 148 is retained in outboard support bracket 142. The outboard support bracket is movable laterally, by the hydraulic control circuit, along with guide rods 144, 146.

A cylindrical socket 300 is formed in the free end of shaft 148, and a threaded bore 302 is drilled through the socket. The base 304 of tapered bearing 306 is secured within socket 300 by threaded fastener 308, which is advanced through the axial passage 310 in the bearing and into threaded engagement with bore 302.

Spindle 312 is secured in outboard support bracket 142 in relative alignment with the fixed end of central shaft 148. An outwardly opening aperture 314 is shaped, in a complementary fashion, to receive tapered bearing 306. The aperture is sufficiently large to accommodate the head of fastener 308, also.

An annular channel 316 is formed in end cap 312, and an annular seal 318 projects into the channel, thus forming a barrier to prevent dust, debris, etc. from degrading the contact areas between bearing 306 and aperture 314, and protecting tapered bearing 306 from damage when outboard support 142 for the drive drum assembly is in retracted position.

Ball bearing assembly 323, includes ball bearings 320 which move freely within an annular race 322 as end cap 312 rotates in unison with central shaft 148. Annular seal 324 keeps debris, etc. from attacking the ball bearing assembly. A retainer 326 is screwed into engagement with the ball bearing assembly 323 on end cap 312, while a similar retainer 328 is screwed into engagement with the outermost spacer 162 on the free end of central shaft 148, retaining pulleys 164 on central shaft 148. A bearing retainer 330 extends about spindle 312, and is retained in position by fastener 332, thus clamping the bearing assembly in the outboard support bracket 142.

Figure 11:
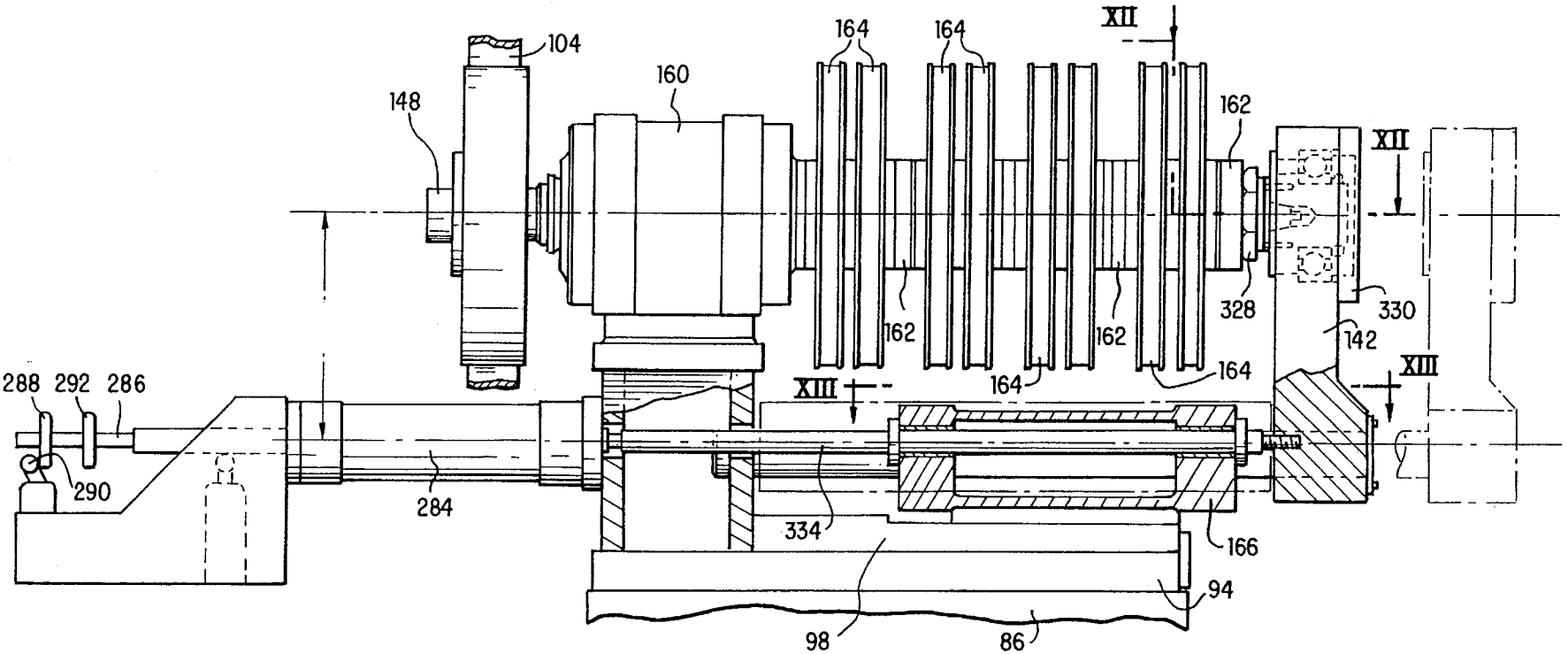
FIG. 11 is a rear elevational view of the drive drum assembly of the multiple belt grinding machine, such view being taken along line XI—XI in FIG. 7 and in the direction indicated.
Figure 12:
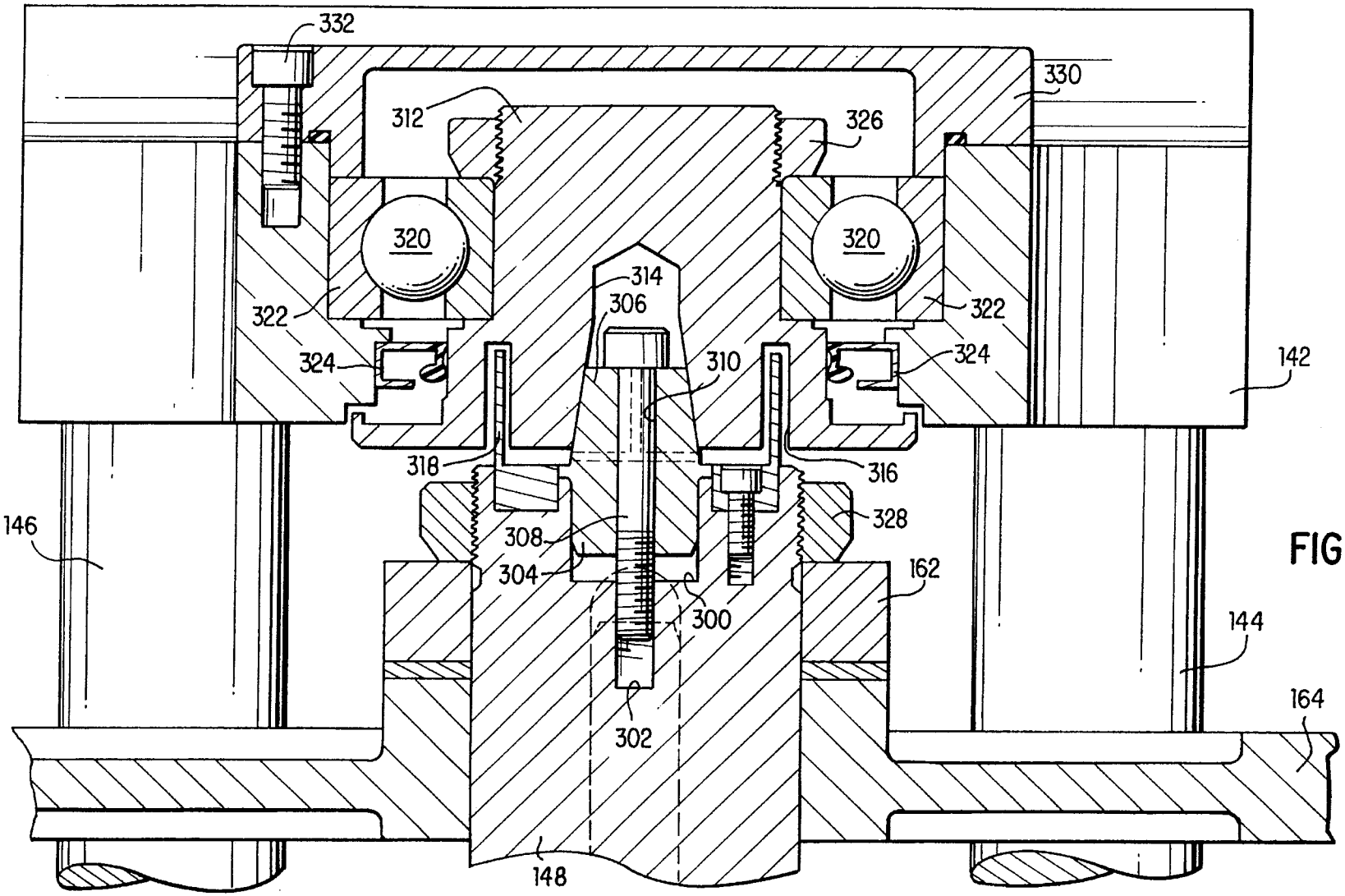
FIG. 12 is a cross-sectional view, on an enlarged scale, of the tapered bearing constructed in accordance with the principles of the instant invention, such view being taken along line XII—XII in FIG. 11 and in the direction indicated.
Figure 13:
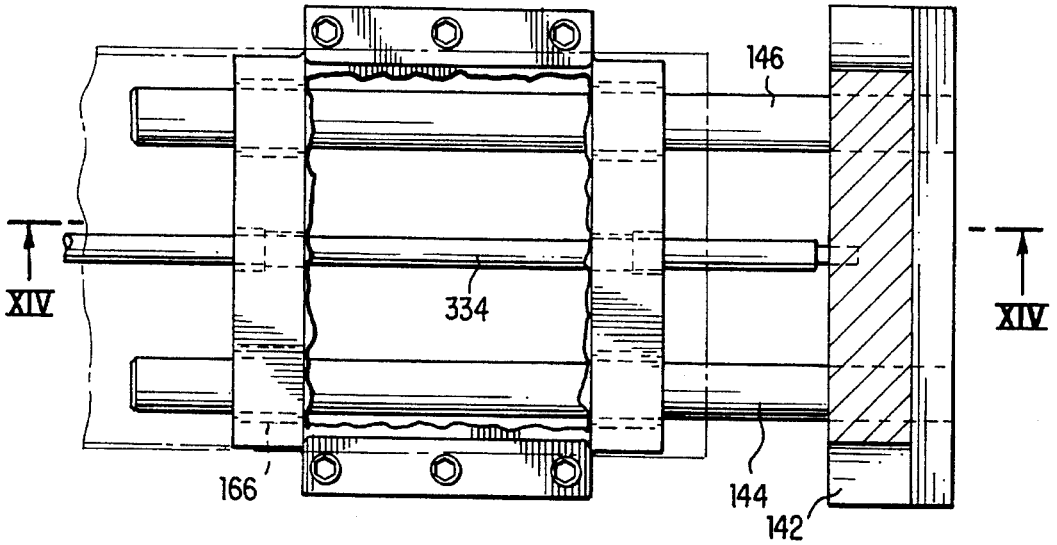
FIG. 13 is a top plan view, with the top removed, of the mechanism for shifting the outboard bracket of the drive drum assembly, such view being taken along line XIII—XIII in FIG. 11 and in the direction indicated.

The lateral movement of support bracket 142 is controlled by hydraulic circuitry (not shown) including hydraulic cylinder 284 which extends, and retracts, rod 286. Rod 286, in turn, drives ram 334, which passes through guide block 166 and is screwed into engagement with the enlarged base of support bracket 142, as shown in FIGS. 11 and 13. When hydraulic cylinder 284 is pressurized to retract, rod 286 is extended and support bracket 142 is drawn laterally into engagement with tapered bushing 306, so that central shaft 148 of drive assembly is supported in a rigid, sag-free manner. The sloping wall of aperture 314 fits snugly upon the tapered bearing, and such interaction "pre-loads" the drive assembly and ball bearing assembly 323 to enable slip-free start up and efficient high speed operation.

When the hydraulic circuit is pressurized to its advanced position, hydraulic cylinder 284 retracts rod 286 which forces ram 334 outwardly (to the right as shown in FIG. 11). The movement of ram 334 shifts bracket 142 laterally away from the end of central shaft 148 (to the position shown in dotted outline in FIG. 11). In such position, the operator gains ready access to the abrasive belts entrained around large pulleys 164, and can inspect, service and/or replace, such belts, as needed.

Numerous changes, revisions, and refinements, may occur to the skilled artisan from the foregoing description of the preferred embodiment of the instant invention. For example, the angle of taper on the bearing and on the wall of the aperture in the end cap may be varied, as long as a surface to surface contact in maintained. Consequently, the appended claims should be broadly construed, and should not be limited to their literal terms.

We claim:

1. A belt grinding machine comprising:

a) a bed, b) means adapted to support a workpiece that extends laterally across said bed, c) a drive drum assembly carried by said bed, d) said drive drum assembly comprising a central shaft with pulleys spaced therealong, e) a positioning slide mounted for longitudinal movement along said bed, f) a feed assembly for said positioning slide, g) a contouring head assembly mounted atop said positioning slide for movement therewith, h) abrasive belt receiving means disposed within said contouring head assembly, i) a plurality of endless belts having at least abrasive sides and backing sides, with each such belt being of a predetermined size and configuration and being entrained in spaced, substantially parallel, relationship about said drive drum assembly and said abrasive belt receiving means of said contouring head assembly, j) a fixed bearing support located at one side of said positioning slide to receive one end of said central shaft of said drive drum assembly, k) a moveable bearing support located at the other side of said positioning slide and adapted to receive the opposite free end of said central shaft of said drive drum assembly, l) means for shifting said movable bearing support laterally to engage said central shaft of said drive drum assembly, m) the invention being characterized by a tapered bearing projecting outwardly from said free end of said central shaft, and a spindle is located within said movable bearing support to receive said tapered bearing and support said drive assembly in a rigid, sag-free relationship.

2. The invention as defined in claim 1 wherein an aperture is defined within said spindle that is complementary in shape to the tapered bearing on said central shaft, so that said bearing is engaged within said spindle over a large contact area.

3. The invention as defined in claim 1 wherein a socket is formed in said free end of said central shaft, the base of said tapered bearing fits within said socket, and a fastener secures the base of said bearing within said socket.

4. The invention as defined in claim 1 wherein said spindle is retained within a ball bearing assembly within said movable bearing support.

* * * * *